United States Patent [19]

Garaty

[11] 4,005,811

[45] Feb. 1, 1977

[54] ROOF BOLT INJECTION MAST

[75] Inventor: John Francis Garaty, Fairy Meadow, Australia

[73] Assignee: Australian Iron & Steel Works Proprietary Limited, Port Kembla, Australia

[22] Filed: May 27, 1975

[21] Appl. No.: 581,183

[30] Foreign Application Priority Data

May 30, 1974 Australia ..... 7714/74

[52] U.S. Cl. ..... 227/124; 227/130

[51] Int. Cl.[2] ..... B25C 5/10

[58] Field of Search ..... 227/124, 130

[56] References Cited

UNITED STATES PATENTS

| | | | |
|---|---|---|---|
| 3,082,898 | 3/1963 | Bosch | 72/391 |
| 3,254,522 | 6/1966 | Elliott et al. | 72/391 |
| 3,601,303 | 8/1971 | Leach | 227/124 |
| 3,819,101 | 6/1974 | Elders et al. | 227/130 |
| 3,847,321 | 11/1974 | Charlez | 227/124 |
| 3,863,825 | 2/1975 | Elders et al. | 227/130 |

*Primary Examiner*—Granville Y. Custer, Jr.
*Attorney, Agent, or Firm*—Ladas, Parry, Von Gehr, Goldsmith & Deschamps

[57] ABSTRACT

This invention relates to a roof bolt injection mast comprising an elongate member having a length slightly less than the height from the floor to the roof of a tunnel or gallery in which the mast is to be operated, the elongate member being provided with a passage which extends therethrough from one end to the other and a port extending through the sidewall thereof to communicate with the said passage, a portion of the passage extending from the lower end of the member to the point of communication with the port being enlarged whereby a fluid introduced through said port will provide the means whereby a first piston disposed in the enlarged portion of the passage is operable to lock the mast between the floor and the ceiling while a second piston disposed in the main passage provides the means whereby a roof bolt disposed therein will be injected into the roof under the influence of the fluid introduced through the port.

10 Claims, 3 Drawing Figures

ROOF BOLT INJECTION MAST

This invention relates to the field of roof bolt injection apparatus and more particularly to a new and improved roof bolt injection mast.

BACKGROUND OF THE INVENTION

In underground mining operations it is usually necessary for the roof to be bolted at spaced intervals along the tunnel or gallery, which bolting can be performed in a number of different ways. In recent years mining operators have been looking for ways of performing this function more efficiently and more economically than has been previously possible. In this regard the provision of apparatus which simplifies the function to a point where the skill of the operator is reduced dramatically is a distinct economic advantage.

The present invention provides such a simplified means of bolting the roof of a tunnel without the need for highly sophisticated equipment or even a high degree of skill on the part of the operator and, as such, is a distinct improvement over the present apparatus.

One of the prior art apparatuses comprises a framework which is mounted in a vertical position on the floor of the tunnel and has a pair of hydraulic rams and a chain which is positioned between the vertical legs of the frame in an M-like configuration with its ends connected respectively to the hydraulic rams. The roof bolt to be injected is positioned on the chain at approximately the centre thereof which forms the centre leg of the M. The hydraulic rams are then extended to draw downwardly the outer legs of the M thereby forcing upwardly the centre leg thereof, such that the roof bolt will be forced into the roof.

One of the problems with this type of apparatus is that the chain is inclined to fracture thereby placing the operator and anybody nearby at great risk during injection of the bolt.

OBJECTS OF THE INVENTION

It is a primary object of this invention to provide a roof bolt injection mast which is substantially free from the defects of the prior art.

Another object of the invention is to provide a roof bolt injection mast which enables a relatively unskilled operator to inject a roof bolt into the roof of a tunnel substantially more efficiently than has heretofor been possible.

BRIEF DESCRIPTION OF THE INVENTION

Broadly, the invention comprises a roof bolt injection mast defined by a longitudinal pillar-like member having a cylindrical bore extending therethrough from end to end. The member is adapted to be positioned vertically in a mine shaft and has at its lower end an enlarged passage communicating axially with the passage that extends longitudinally through the member. Each passage has a piston disposed therein which provides the means whereby a high pressure fluid injected into the enlarged passage at a point intermediate the connection between the passages may react on the pistons to sequentially lock the mast in position between the roof and the floor and drive a roof bolt positioned in the firstmentioned passage upwardly into the roof of the tunnel.

DESCRIPTIONS OF THE DRAWINGS

Figure 1:
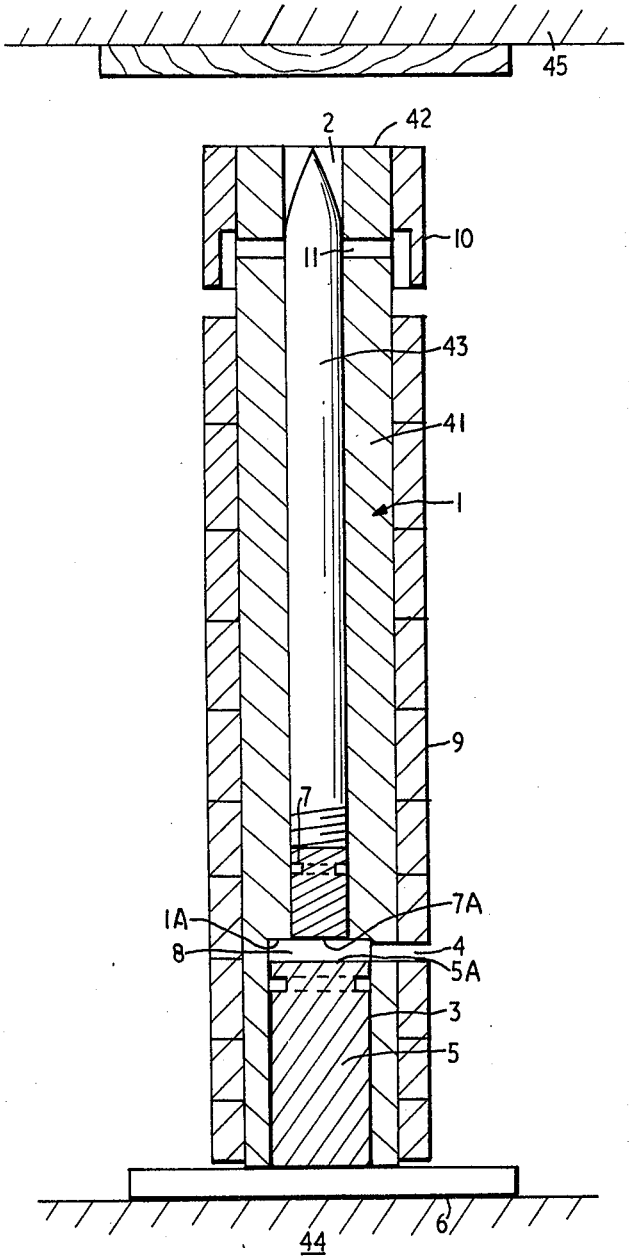
Figure 1A:
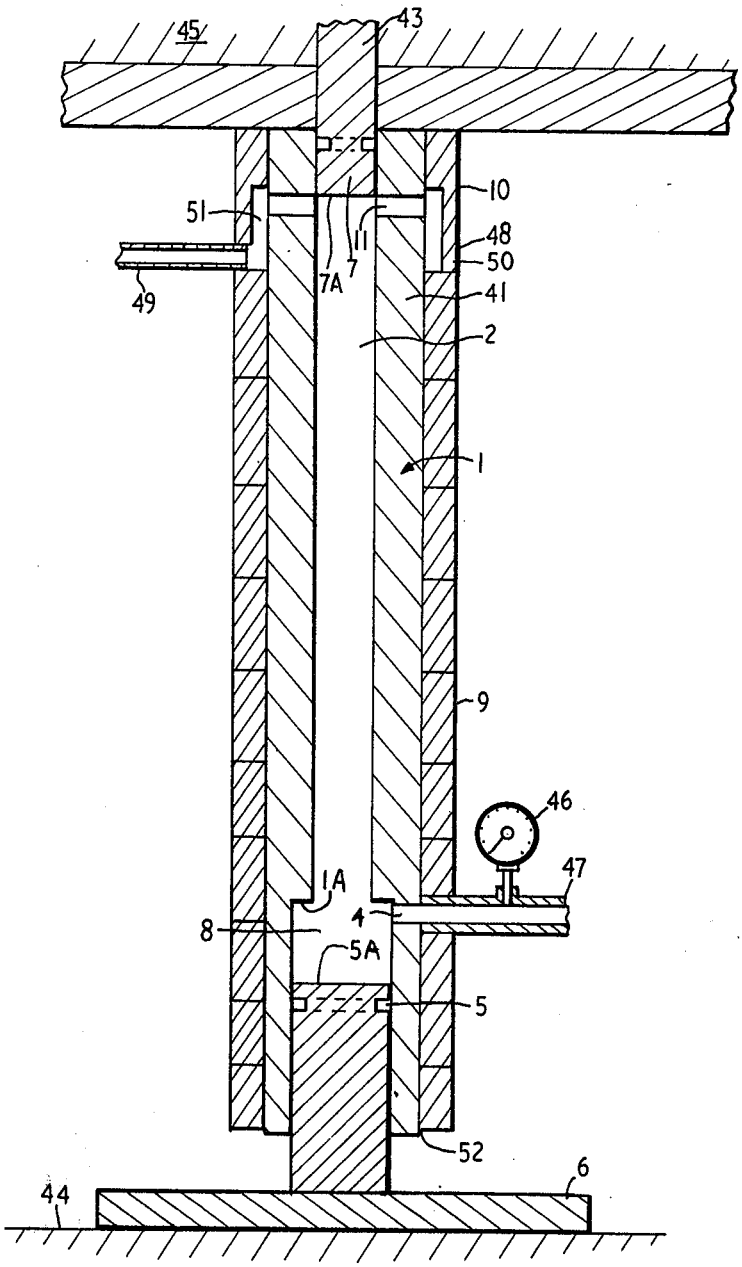
Figure 2:
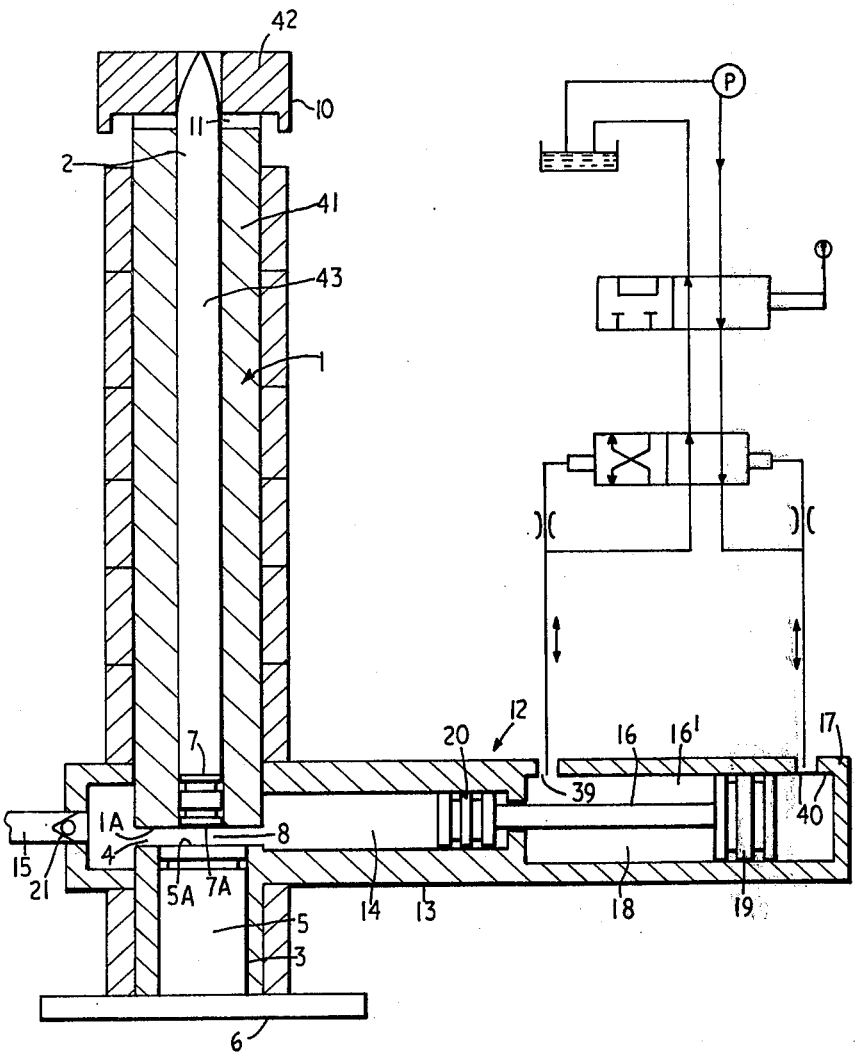

Notwithstanding any other forms that may fall within its scope the invention will hereinafter be described by way of example only with reference to the accompanying drawings of which FIG. 1 is a sectional elevation of a roof bolt injection mast according to the invention, FIG. 1A is a sectional elevation of a modification of the invention, and, FIG. 2 is a sectional elevation of an improved version of the injection mast of FIG. 1.

PREFERRED EMBODIMENT

The invention as illustrated in the drawings is a roof bolt injection mast comprising an elongate member 1 having a cylindrical passage 2 extending for some distance longitudinally therethrough to communicate with a second passage 3 at the opposite end thereof. The second passage 3 is substantially larger in diameter than the first passage 2 and extends for only a short distance into the member 1 from one end thereof. Adjacent the point of communication between the passages 2 and 3 is a transverse port 4 which provides the means whereby high pressure fluid may be supplied to the passages. Disposed within passage 2 is a piston 7 which provides the means whereby a roof bolt 43 may be ejected from the mast into the roof 45 of a tunnel.

In a bolt injection process it is eminently desirable that the mast be locked in position to prevent accidents. This is achieved by means of a piston 5 disposed within the larger passage 3. The piston 5 has a length less than the length of the passage 3 thereby providing an area 8 into which high pressure fluid may be pumped.

With the mast disposed in a vertical position between the floor 44 and the roof 45 of a tunnel, the high pressure fluid entering through port 4 into passage area 8 will react on surface areas 1A, 5A and 7A. Because the fluid will have a tendency to move in the direction of least resistance the roof bolt 43 will, where the resistance of piston 7 is less than the resistance applied by the weight of the mast, be urged into contact with the roof 44. Once this has occurred the fluid will then act on combined surface areas 1A and 7A to urge them away from surface 5A of the piston. As surface 7A of the piston 7 now has a resistance greater than the resistance of the mast the fluid will react on surfaces 5A and 1A to extend piston 5 and lock the mast between the roof 45 and the floor 44. Once the pillar is locked in position the piston 5 which has a substantially greater area than piston 7 forms an immovable end wall, thus enabling the fluid to react on piston 7, which now offers the least resistance to movement, to force it longitudinally through the passage 2 towards the roof of the tunnel. As a result of this longitudinal movement in the passage 2 the piston 7 will force a roof bolt 43 disposed therein into the roof 45 of the tunnel. Preferably, the piston 7 forms an integral part of the roof bolt 43, thus in effect, making the piston 7 a one shot disposable item.

Once the roof bolt 43 has entered the roof strata to the full desired depth it is necessary to cease the thrust action. Because the operator cannot see the roof bolt there is no means by which he may observe when the bolt has reached the required depth. Accordingly, the means by which the thrust power is ceased may be achieved by the provision of a pressure gauge 46 in the fluid supply line 47 so that upon the pressure of the fluid in the line rising above a predetermined level the operator shuts off the fluid supply.

The most preferable method, however, is the provision of exhaust ports 11 which extend radially through the wall 41 at a point near the upper end 42 of the mast. The function of the ports 11 is to provide a pressure drop in the passage 2 once the innermost end of the piston 7 passes the ports 11. High pressure fluid ejecting from the ports 11 is deflected in a generally downward direction by shroud 10 which may, if so desired, provide the means whereby by-pass fluid from the ports 11 may be returned to source. In this case the lower end 48 of the shroud 10 will be circumferentially closed off, as shown in FIG. 1A, by a lower shroud portion 50 to define a circumferential gallery 51 to which a return line 49 is connected. The position of the ports 11 is adjusted according to the depth the roof bolt is to be injected but should not be sufficiently spaced from the upper end of the mast to provide a situation where when the mast is unclamped it cannot be removed from its position because the roof bolt projects too far into the passage 2. In this regard the distance that these ports 11 are spaced from the upper end of the mast and the stroke required by the piston 5 to lock the mast in position should be selected to provide the correct projection.

To spread the thrust load the mast is provided with a base 6 which has sufficient area to prevent injection of the piston 5 into the floor surface.

To those skilled in the art it will be immediately apparent that to successfully inject a roof bolt a number of parameters must be met. Firstly, the passage 2 must only be sufficiently larger in diameter than the roof bolt to enable the roof bolt to slide therethrough. Thus, assuming that the roof bolt has a maximum diameter of 0.625 inch (15.875 mm) the diameter of passage 2 should be at least 0.001 inch (0.0254 mm) greater than the roof bolt to enable it to slide freely through the passage 2. It is also desirable that the piston 5 be only sufficiently larger than the piston 7 to provide for the clamping of the roof bolt injection mast into position.

Those skilled in the art will appreciate that because of relatively small diameter of piston 7 and the type of material into which the roof bolt is to be injected, it is necessary to use relatively high pressures. These pressures which should be in the region of approximately 150,000 p.s.i. naturally provide handling problems.

Where low pressures in the order of 4,000 to 5,000 p.s.i. are used, there are little or no handling problems. When pressures are increased above this level a number of dangers are involved for persons nearby should leaks occur in the pipelines. It is desirable, therefore, that the high pressure lines be kept to a minimum length. The apparatus illustrated in FIG. 2 is an ideal example of how this may be achieved. In this form the elongate member 1 is substantially the same. Inlet port 4, however, is extended completely through the member 1 to provide an interconnection between low pressure fluid inlet supply 15 and high pressure chamber 14 of an intensifier 12 mounted directly on the member 1. The intensifier 12 comprises a body 13 having a chamber portion 16' in which a piston 19 is disposed. The piston 19 is connected to a second piston 20 disposed in chamber 14 by piston rod 16.

In operation a relatively low pressure fluid is introduced through port 39 into portion 18 of chamber 16 to drive the pistons 19 and 20 rearwardly into their illustrated position. The low pressure fluid supply may then be transferred from port 39 to port 40 to pressurize chamber portion 17 to move the pistons 19 and 20 towards the member 1.

The rearward motion of the piston 20 will cause fluid to be drawn in from conduit 15 through a non-return valve 21 and port 4 into the chamber 14. Forward motion of the piston 20 will then compress the fluid in chamber 14 and cause it to urge piston 7 longitudinally through the bore 2. By virtue of the differential areas between piston 19 and piston 20 the pressure applied to piston 7 by means of the intensifier 12 will be substantially greater than the pressure applied through port 40. Thus it will be seen that by this process continuous reciprocation of the piston 20 will supply sufficient fluid at a high pressure to the mast to drive the roof bolt 43 into the roof 45.

It will be appreciated by those skilled in the art that by use of automatic changeover valves piston 20 may be continually reciprocated until fluid flows through port 11. At this point the pressure drop that occurs as the fluid passes through port 11 is sufficient to reduce the operational pressure to a safe level. The maximum pressure of the fluid should be in the range of 50,000 to 150,000 p.s.i. To ensure that the wall 41 of the member 1 does not rupture or buckle under the influence of the high pressure fluid a series of collars are shrink fitted onto the member 1 thereby increasing the strength and rigidity of the wall 41.

What I claim is:

1. A roof bolt injection mast comprising an elongate member having upper and lower ends, passage means extending through said member from end to end, a first piston disposed in a portion of said passage means at the lower end thereof, high pressure fluid inlet means communicating with said passage means adjacent the upper end of said first piston, and means providing for relative movement between said member and said first piston under the influence of a high pressure fluid introduced through said inlet means; whereby high pressure fluid will sequentially lock said member between the floor and the roof of a tunnel and inject a roof bolt from said passage means into the strata of said roof by means defining a second piston received in said passage means; said first piston and said portion of said passage means having substantially larger diameters than said means defining said second piston and the remainder of said passage means and said second piston and the remainder of said passage means having diameters substantially the same as the diameter of said roof bolt.

2. A roof bolt injection mast as in claim 1 including exhaust port means in said body for causing a pressure drop in said passage means when said roof bolt has reached a predetermined penetration depth.

3. A roof bolt injection mast as in claim 1 including base plate means connected to the lower end of said first piston.

4. A roof bolt injection mast as in claim 1 including strengthening means on said elongate member.

5. An injection mast for injecting a roof bolt into the roof of a tunnel, comprising elongate body means having passage means extending therethrough from end to end to receive roof bolt means, an enlarged portion at the lower end of said passage means, a first piston disposed in said passage means, a second piston disposed in said enlarged portion and means defining a fluid inlet zone between said pistons whereby upon supply of fluid introduced at said zone at a high pressure said second piston will move away from said first piston to lock said mast between the floor and the roof of the tunnel and said first piston will then move away from said second piston to drive roof bolt means from said passage means into the roof of said tunnel.

6. A roof bolt injection mast as in claim 5 wherein the fluid is charged to an operational pressure of about 150,000 p.s.i.

7. A roof bolt injection mast as in claim 5 including an intensifier operable by a relatively low pressure fluid to deliver said supply of fluid at said high pressure.

8. A roof bolt injection mast as in claim 7 wherein said intensifier comprises a first chamber communicating with said fluid inlet zone, a second chamber axially aligned with said first chamber, a third piston in said first chamber and connected to a fourth piston in said second chamber, a fluid inlet to said first chamber, a non-return valve in said inlet, first and second fluid inlets communicating with said second chamber at opposite sides of said fourth piston providing the means whereby said third and fourth pistons may be reciprocated, said fourth piston having a greater surface area than said third piston whereby a relatively low pressure applied to said fourth piston will result in said supply of fluid delivered to said inlet zone having sufficient pressure to cause said roof bolt to be forced into said roof.

9. A roof bolt injection mast as in claim 8 wherein said elongate body is cylindrical in cross section and has a plurality of strengthening collars shrunk onto the outer surface thereof to substantially prevent rupture of said body during use thereof.

10. A roof bolt injection mast comprising an elongate body for positioning in an upright position in a tunnel or the like, a passage means extending through said body from end to end, an upper portion of said passage means being arranged to receive a a roof bolt therein, a lower portion of said passage means being larger in diameter than said upper portion and having a piston therein, said piston being operable under the influence of a high pressure fluid introduced into said passage means through fluid inlet means to lock said mast between the roof and the floor of said tunnel, said fluid being operable to eject a roof bolt from said passage means into said roof.

* * * * *

UNITED STATES PATENT AND TRADEMARK OFFICE

CERTIFICATE OF CORRECTION

PATENT NO. : 4,005,811

DATED : February 1, 1977

INVENTOR(S) : Garaty, John Francis

It is certified that error appears in the above-identified patent and that said Letters Patent are hereby corrected as shown below:

On the cover sheet, left column, the name of the assignee should read-- Australian Iron & Steel Proprietary Limited Hoskins Kembla Works, New South Wales Australia --.

Signed and Sealed this twenty-sixth Day of July 1977

[SEAL]

*Attest:*

RUTH C. MASON
*Attesting Officer*

C. MARSHALL DANN
*Commissioner of Patents and Trademarks*